US006247863B1

(12) United States Patent
Lin

(10) Patent No.: US 6,247,863 B1
(45) Date of Patent: Jun. 19, 2001

(54) PRESS TYPE MECHANICAL PENCIL

(76) Inventor: Casio Lin, 5F, No.16, Alley 65, Lane 14, Sec. 7, Chung San N. Road, Taipei (TW)

( * ) Notice: Subject to any disclaimer, the term of this patent is extended or adjusted under 35 U.S.C. 154(b) by 0 days.

(21) Appl. No.: 09/458,946

(22) Filed: Dec. 10, 1999

(51) Int. Cl.[7] ..... B43K 21/16

(52) U.S. Cl. ..... 401/67; 401/65; 401/89; 401/94

(58) Field of Search ..... 401/65–67, 82, 401/85, 89, 92–94

(56) References Cited

U.S. PATENT DOCUMENTS 2,049,965 * 8/1936 Leistenschneider ..... 401/65
4,583,874 * 4/1986 Kageyama ..... 401/85
4,659,242 * 4/1987 Katz ..... 401/85
4,895,467 * 1/1990 Kageyama et al. ..... 401/65
5,022,772 * 6/1991 Kageyama et al. ..... 401/65

* cited by examiner

*Primary Examiner*—Steven O. Douglas
*Assistant Examiner*—Kathleen J. Prunner
(74) *Attorney, Agent, or Firm*—Dougherty & Troxell

(57) ABSTRACT

A press type mechanical pencil includes an upper barrel, a press device, a refill tube, an abutting rod, a clamp/release device and a lower barrel. An insert post of the clamp/release device has a top portion connected to the abutting rod which is centrally provided with a refill hole for passage of refills. A refill tube is disposed between the abutting rod and the press device. A storage tube has a tube chamber for receiving a plurality of refills, and an open end connected to a tube plug. The tube plug is adapted to guide the refills and for connection with the abutting rod. A neck hole therein provides passage for only one refill through the refill hole into the clamp/release device.

3 Claims, 3 Drawing Sheets

PRESS TYPE MECHANICAL PENCIL

BACKGROUND OF THE INVENTION

1. Field of the Invention

The present invention relates to a press type mechanical pencil, more particularly to a press type mechanical pencil having a cartridge type refill tube, and to a cartridge type refill tube for use in a press type mechanical pencil.

2. Description of Related Art

There are available on the market traditional pencils having a piece of graphite enclosed in a wooden cylinder, no-sharpening pencils, and mechanical pencils.

In use, traditional pencils need to be sharpened with the use of a pencil sharpener or a cutter. No-sharpening pencils are pencils having a plurality of sharpened graphite pieces fixed in plastic units stored in a cylinder of plastic. In use, when one of the graphite pieces has become blunt due to writing, it is removed from a rear end of the cylinder and inserted into a top end of the cylinder to allow the graphite piece now at the rear end to extend out of the cylinder for writing purposes. Both of these two types of pencils cannot be used after a period of time since the graphite pieces will be used up. Besides, traditional wood pencils have to be sharpened from time to time.

Mechanical pencils are developed to improve the drawbacks of the above-mentioned pencils. A conventional mechanical pencil includes a barrel containing a hollow refill storing tube, an upper end thereof being connected to a press portion. When the press portion is depressed, a spring of a clamp/release portion below the refill storing tube is compressed so that clamp pawls at an end portion thereof open to allow passage of an elongate refill through the clamp/release portion and extension thereof from a tapered portion at the bottom portion of the barrel for writing purposes. An advantage of mechanical pencils is that the refills have a certain diameter, the width of the lines written can be consistent. Besides, the refills are refillable.

In use, with mechanical pencils, the refills have to be pre-stored in a hollow refill storing tube. When a refill is used up, the press portion is taken down to allow replacement of a new refill. As the refill has a very small diameter, it may easily break if not handled with care. In addition, the user has to touch the refill, which may stain the user's fingers. Furthermore, conventional refill storing tubes are usually small and cannot contain too many refills to reduce the frequency of refilling. These are problems to be overcome in the art.

SUMMARY OF THE INVENTION

A primary object of the present invention is to provide a press type mechanical pencil and a cartridge type refill tube therefor to eliminate the drawbacks in the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
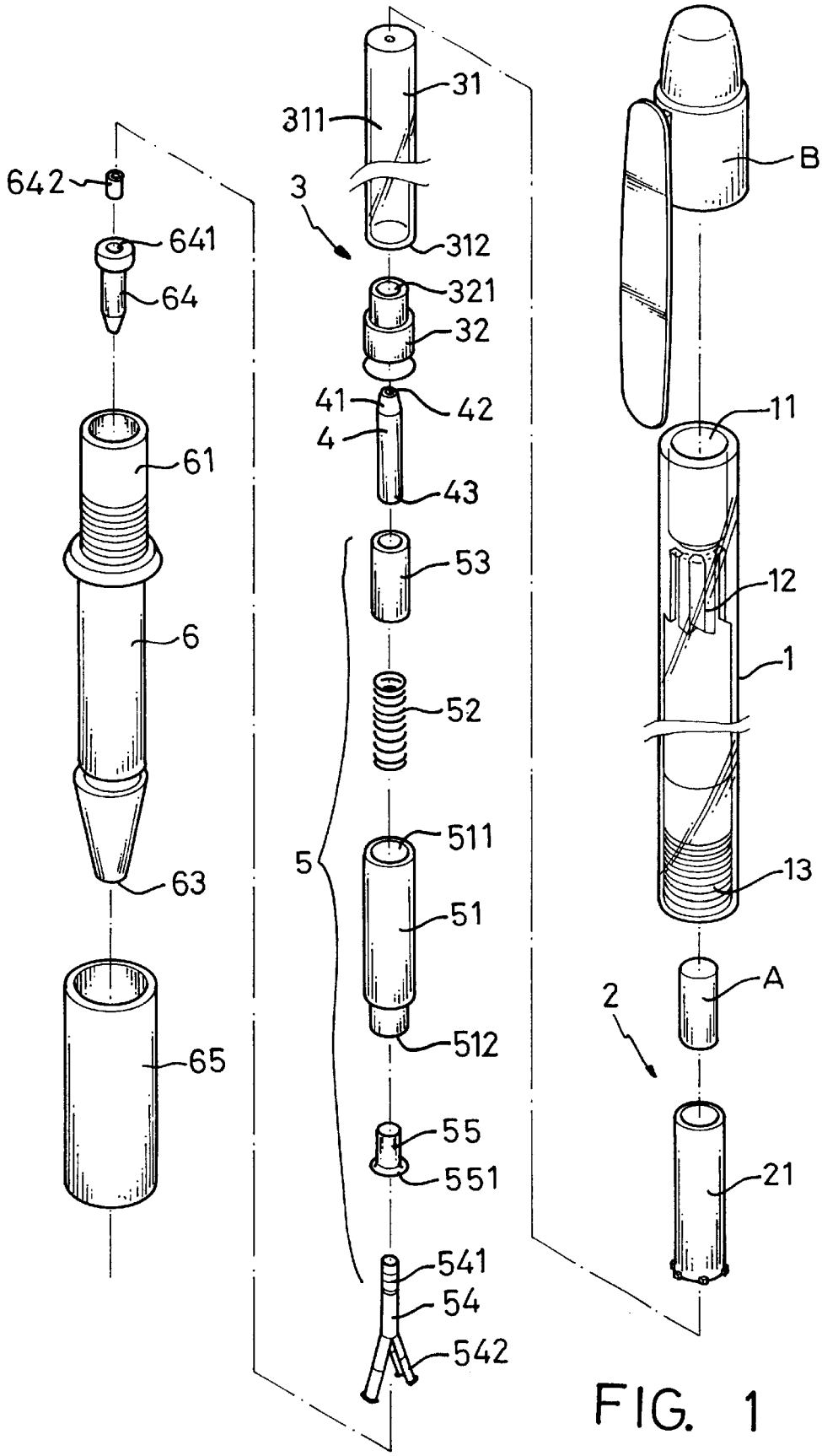
FIG. 1 is an exploded perspective view of a press type mechanical pencil of the present invention.
Figure 2:
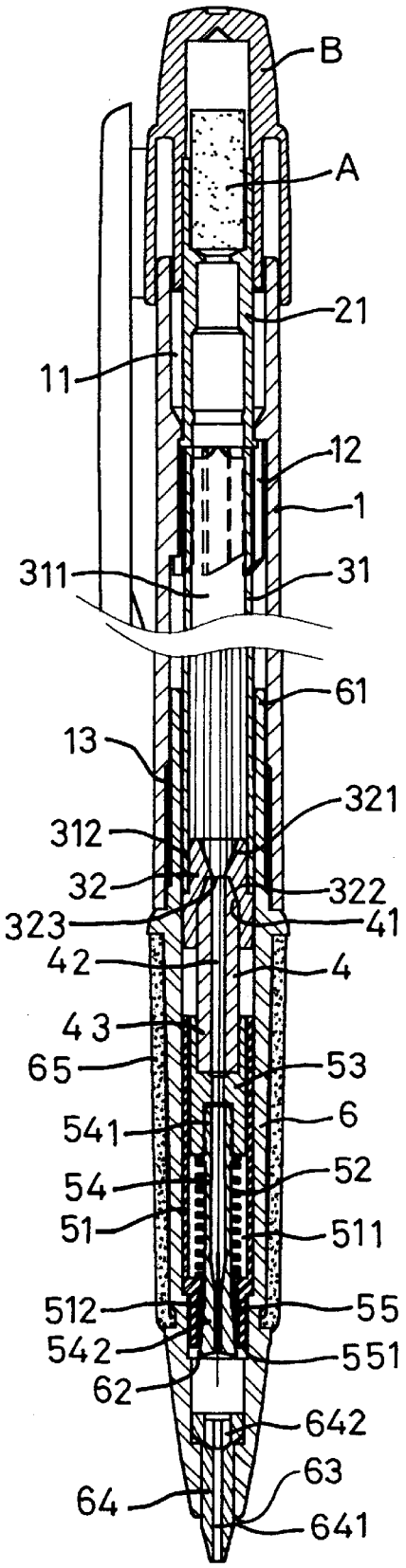
FIG. 2 is an assembled sectional view of the present invention prior to a pressing action.
Figure 4:
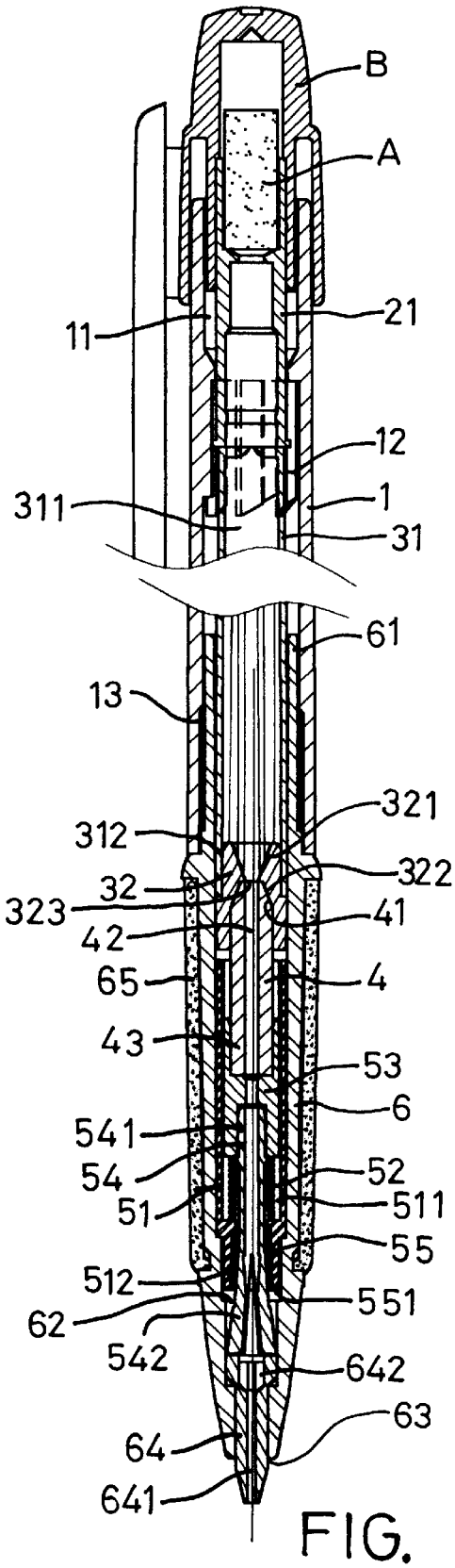
FIG. 4 is an assembled sectional view of the present invention after a pressing action.
Figure 3:
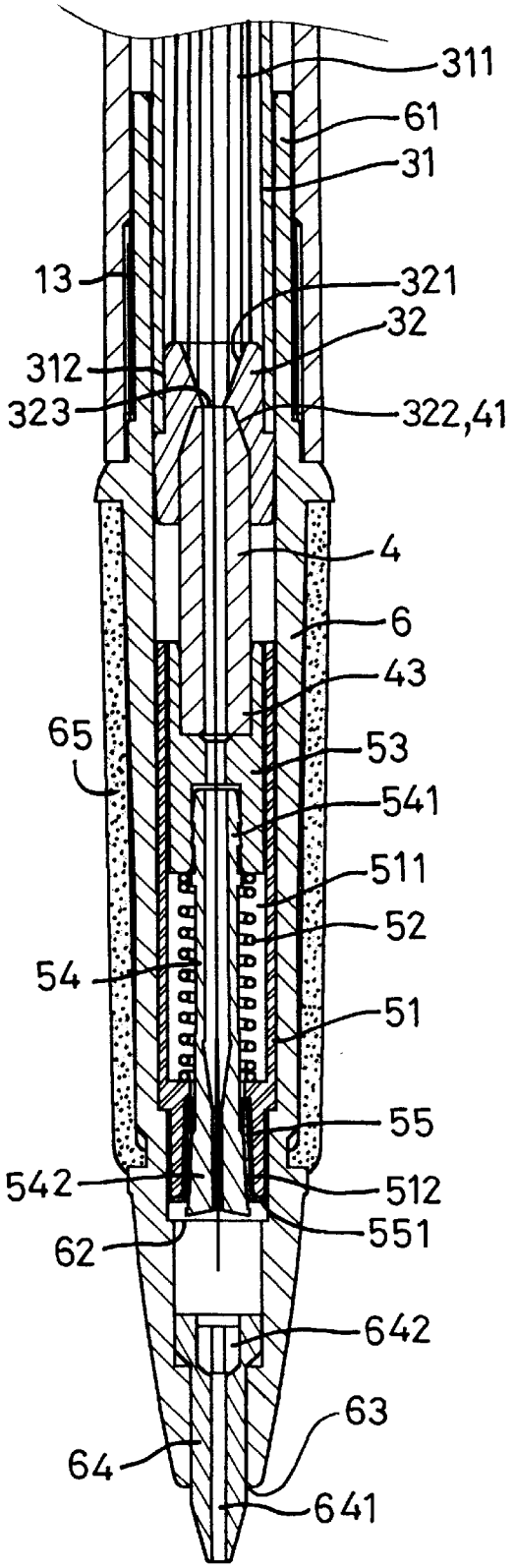
FIG. 3 is an enlarged view of FIG. 2 in part.
Figure 5:
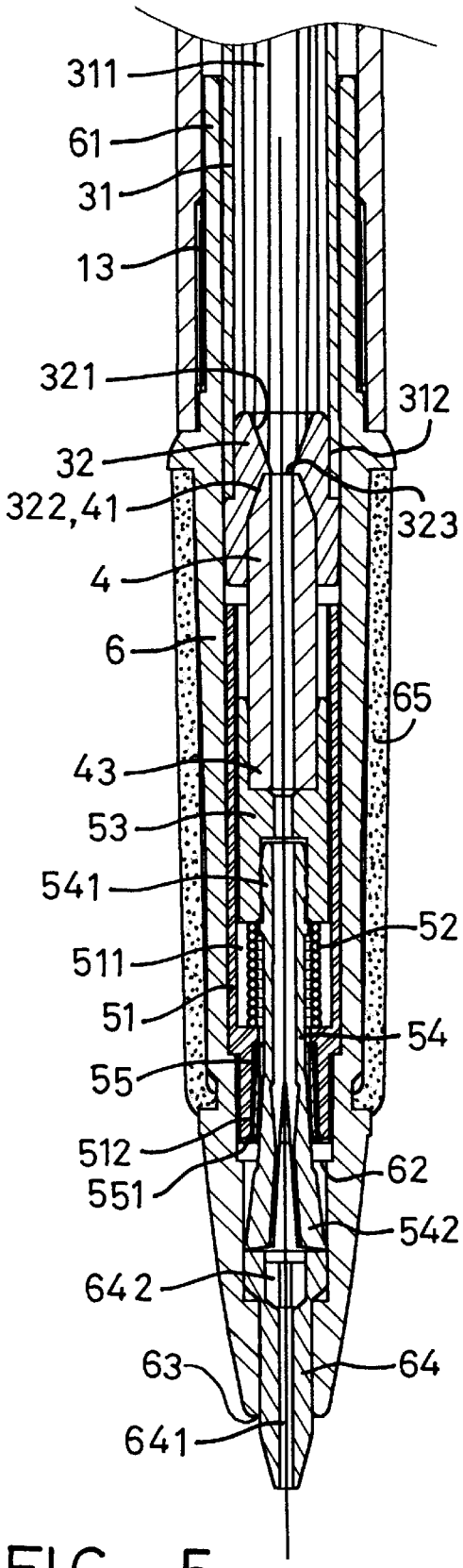
FIG. 5 is an enlarged view of FIG. 4 in part.

With reference to FIGS. 1 to 3, the present invention includes an upper barrel 1, a thrust device 2, a refill tube 3, an abutting rod 4, a clamp/release device 5, and a lower barrel 6.

The upper barrel 1 is a hollow rod-like structure having a top opening portion 11 provided with a limiting means 12 for receiving and limiting the thrust device 2 to thereby prevent the latter from slipping out of the opening portion 11. The upper barrel 1 has a bottom portion provided with a connecting portion 13 for threaded or snapped engagement with the lower barrel 6. After assembly, a space is confined between the upper and lower barrels 1, 6 to receive the refill tube 3, the abutting rod 4, and clamp/release device 5.

The thrust device 2 is a known device that is disposed in the opening portion 11. The thrust device 2 includes a press rod 21 that can displace longitudinally inside the limiting device 12 when pressed to compress the refill tube 3. In the drawings, a conventional trip type thrust device is shown in part, a detailed description thereof is therefore dispensed herein. Certainly, the thrust device 2 of the present invention is not limited to that shown in the drawings. In addition, as is known in the art, the top portion of the press rod 21 may be fitted with an eraser A before being inserted into a press cap B. When the press cap B is pressed, the press rod 21 displaces downwardly and is reset due to the action of a spring 52 of the clamp/release device 5.

The refill tube 3 includes a storage tube 31 and a tube plug 32. The storage tube 31 has a hollow tube chamber 311 for receiving a plurality of refills, and an open end 312 insertably coupled with the tube plug 32. The tube plug 32 has top and bottom portions respectively having opposed top and bottom conical portions 321, 322, a neck hole 323 therebetween allowing passage of only one refill to facilitate entry of the refill into the abutting rod 4.

The abutting rod 4 has a top portion forming a rod taper 41 that is connected to the bottom conical portion 322, and a central through refill hole 42 for passage of the refills. The abutting rod 4 further has a rod end 43 at a bottom portion for insertion into the clamp/release device 5.

The clamp/release device 5 is a known structure that receives the refill transferred from the abutting rod 4 and that has pawls for performing clamping and releasing actions so that the refill can extend out of the lower barrel 6. The clamp/release device 5 shown in the drawings of the present invention includes a stepped rod 51 having a top portion forming a rod slot 511, and a spring 52 and an insert post 53 received in the rod slot 511. The insert post 53 has a top portion connected to the rod end 43, and a bottom portion insertably connected to a clamping pawl means 54. The clamping pawl means 54 has a clamping rod 541 at a top portion thereof that passes through a clamp/release ring 55 in an annular slot 512 at the bottom portion of the stepped rod 51 and that is further connected to the bottom portion of the insert post 53 to achieve linking-up movement. In addition, the bottom portion of the clamp/release ring 55 is provided with an annular rim 551 projecting from the bottom portion thereof and urging against the open end of the annular slot 512. The clamping pawl means 54 has two or more tapered pawl portions 542 received in the clamp/release ring 55. When the insert post 53 is subjected to an external force, it will compress the spring 52 to cause the clamping pawl means 54 and the clamp/release ring 55 to displace downwardly synchronously until the annular rim 551 touches a stop 62 pre-provided on the lower barrel 6. At this point, the pawl portions 542 will continue to displace downwardly and will be in an open state, thereby pushing the refill in the refill hole 42, the insert post 53 and the clamping pawl means 54 downwardly through a short distance. When the force on the insert post 53 is released, the spring 52 will rebound causing the insert post 53 to reset, while the pawl portions 542 retreat into the clamp/release ring 55 to clamp the refill for writing purposes.

The lower barrel 6 is also a hollow rod-like structure that has a top portion provided with a connecting portion 61 corresponding to the connecting portion 13 for engagement therewith. The lower barrel 6 has a bottom portion having an inner wall provided with the stop 62 to serve as a limit for the downward displacement of the clamp/release ring 55 so as to facilitate extension of the pawl portions 542. In addition, a bottom end of the lower barrel 6 is provided with an end hole 63 for extension of the refill for writing purposes. More importantly, the end hole 63 has a refill sleeve 64 fitted therein. The refill sleeve 64 is internally provided with a stepped sleeve hole 641 and has an upper portion for receiving a guide ring 642 to guide the refill to extend from the rear end of the sleeve hole 641. Furthermore, a grip portion of the lower barrel 6 may be fitted with a conventional soft rubber sleeve 65 or provided with corrugated patterns to facilitate gripping of the pencil.

The refill tube 3 disclosed in the present invention can replace conventional refill storage cases and can be coupled with the press type mechanical pencil disclosed in the present invention to replace conventional refill storing tubes. In addition to the tube plug 32, the refill tube 3 may have an adhesive sealing piece or a T-shaped stop post for sealing purposes, so that the refill tube 3 can be sold in a sealed state with the refills prevented from slippage.

The arrangement of the refill tube that is snap-connected with the writing instrument increases refill storage space and effectively replaces conventional refill storage tubes, preventing breaking of refills during refilling. Furthermore, as the refill tube and the abutting rod are connected, the user's fingers will not contact the refill when using the mechanical pencil of the invention. According to statistics, users often misplace the refill storage case after use so that only about 50% of the refills in the refill storage case are used, which is a waste of resources. On the other hand, the refills can all be stored in the refill tube of the mechanical pencil of the present invention to prevent waste of resources and saves expenses.

Although the present invention has been illustrated and described with reference to the preferred embodiment thereof, it should be understood that it is in no way limited to the details of such embodiment but is capable of numerous modifications within the scope of the appended claims.

What is claimed is:

1. A press type mechanical pencil comprising an upper barrel having a top portion with an opening portion provided with a limiting means receiving and positioning a press rod of a thrust device, the upper barrel having a bottom portion provided with a connecting portion engaging with a connecting portion at a top portion of a lower barrel, the lower barrel having a bottom portion with an inner wall provided with a stop, a tapered portion at a rear end thereof having an end hole, a clamp/release device being provided in the lower barrel and including a stepped rod having a rod slot in a top portion thereof receiving a spring and an insert post sequentially, and a bottom portion with an annular slot receiving a clamp/release ring, an annular rim at an end portion thereof serving as a limit for downward displacement, a clamping rod atop a clamping pawl passing through the clamp/release ring, at least two pawl portions at a bottom portion of the clamping pawl, due to the relative movement of the insert post, the spring and the clamp/release ring, causing a refill therein to be displaced and extend out of the end hole for writing purposes, wherein the insert post of the clamp/release device has a top portion connected to an abutting rod which is centrally provided with a refill hole for passage of the refill, a refill tube being disposed between the abutting rod and the thrust device, a storage tube having a tube chamber receiving a plurality of refills, and an open end connected to a tube plug, the tube plug being adapted to guide the refills and for connection with the abutting rod, a neck hole therein providing passage for only one refill through the refill hole into the clamp/release device.

2. The press type mechanical pencil as defined in claim 1, wherein a top portion of the abutting rod has a rod taper, and the tube plug has top and bottom portions having opposed top and bottom conical portions for guiding the refills and for insertable connection with the rod taper.

3. The press type mechanical pencil as defined in claim 1, wherein the end hole of the tapered portion of the lower barrel has a refill sleeve fitted therein which is internally provided with a stepped sleeve hole and has an upper portion receiving a guide ring adapted to guide the refill to extend out of the sleeve hole.

* * * * *